US005507095A

United States Patent [19]

Wetzel et al.

[11] Patent Number: 5,507,095

[45] Date of Patent: Apr. 16, 1996

[54] ELECTRIC SHAVING APPARATUS

[75] Inventors: Matthias Wetzel, Frankfurt; Klaus Oprach, Schwalbach; Bernd Tewes, Wiesbaden-Medenbach; Reinhold Eichhorn, Idstein-Kroeftel; Helmut Dürr, Frankfurt, all of Germany

[73] Assignee: Braun Aktiengesellschaft, Frankfurt, Germany

[21] Appl. No.: 150,172

[22] PCT Filed: May 19, 1992

[86] PCT No.: PCT/EP92/01104

§ 371 Date: May 10, 1994

§ 102(e) Date: May 10, 1994

[87] PCT Pub. No.: WO92/21486

PCT Pub. Date: Dec. 10, 1992

[30] Foreign Application Priority Data

Jun. 3, 1991 [DE] Germany ..... 41 17 990.0

[51] Int. Cl.$^6$ ..... B26B 19/10

[52] U.S. Cl. ..... 30/34.1; 30/43.92

[58] Field of Search ..... 30/34.1, 34.05, 30/43.6, 43.9, 43.92, 346.51

[56] References Cited

U.S. PATENT DOCUMENTS

| | | | |
|---|---|---|---|
| 4,930,217 | 6/1990 | Wolf et al. | 30/34.1 |

FOREIGN PATENT DOCUMENTS

| | | |
|---|---|---|
| 2343116 | 8/1973 | Germany . |
| 2801266 | 1/1978 | Germany . |
| 2843947 | 10/1978 | Germany . |
| 3127999A1 | 7/1981 | Germany . |
| 3509184A1 | 3/1985 | Germany . |
| 3610736A1 | 3/1986 | Germany . |
| 59082 | 7/1969 | Luxembourg . |

*Primary Examiner*—Douglas D. Watts
*Attorney, Agent, or Firm*—Fish & Richardson

[57] ABSTRACT

The invention is directed to an electric shaving apparatus having a short-hair cutter assembly (2) arranged on a housing (1) and at least one control switch (9) slidably mounted on the housing (1) for setting a long-hair trimmer assembly (4) from an "Off" position to at least one or several positions of use. The long-hair trimmer assembly (4) is adjustably mounted on the housing (1) of the shaving apparatus in such a way that it follows the surface of the skin.

29 Claims, 9 Drawing Sheets

ELECTRIC SHAVING APPARATUS

This invention relates to an electric shaving apparatus having at least one short-hair cutter assembly arranged on a housing and at least one control switch slidably mounted on the housing for vertically adjusting a long-hair trimmer in the direction of the short-hair cutter assembly from an "Off" position to at least one operating position.

An electric shaver with a short-hair cutter assembly arranged on a housing and a at least one control switch slidably mounted on the housing is already known (DE-A-28 43 947), the control switch serving to adjust the long-hair trimmer vertically in the direction of the short-hair cutter assembly from an "Off" position into an operating position corresponding to a position of use. The movement of the long-hair trimmer is locked relative to the shaver housing in any position, so that during shaving the long-hair trimmer is only movable into another position of use, for example, a "trimming" position, by actuation of the control switch, in which position the movement of the long-hair trimmer is again locked, being thus unable to change its position while in use.

From DE-A-2 343 116 an electric shaving apparatus is known having a short-hair cutter assembly arranged on the housing and a long-hair trimmer slidable in vertical direction and adapted to be held immovable both in the "Off" position and in a position of use provided above the contour of the short-hair cutter by means of a retaining spring locking into recesses provided on the slide means of the long-hair trimmer, such as to ensure operation of the long-hair trimmer in the predetermined position of use. Taking into account the indicated extreme position of the long-hair trimmer relative to the short-hair cutter assembly, this known shaving apparatus precludes a simultaneous operation of short-hair cutter assembly and long-hair trimmer for cutting short and long hair.

It is an object of the present invention to provide an electric shaving apparatus of the type initially referred to with two cutter assemblies, such as to enable both cutter assemblies to be put to optimum use simultaneously in at least one operating position.

According to the present invention, this object is accomplished in that the long-hair trimmer is spring-mounted in vertical direction in at least one operating position. This ensures in a simple manner that the long-hair trimmer engages the skin surface at a consistently optimum angle, catching and shaving the long hair which the short-hair cutter assembly has not caught or is unable to catch. For example, when the position of the shaver relative to the skin surface is changed while shaving, causing also the skin engaging surface of the short- and long-hair cutter assemblies to be changed, the long-hair trimmer will automatically adapt to the new situation, thereby ensuring that both cutter assemblies continue to engage the skin surface optimally. This improves the shaving performance significantly, while at the same time reducing the aggressive action of the long-hair trimmer assembly, so that the risk of skin irritation or injury can be diminished. As a result, the long-hair trimmer does not get caught on creases on the skin or facial contours as, for example, the jaw bone. The sliding action of the long-hair trimmer over the skin surface becomes more pleasant, presenting an improvement.

In a further feature of the device of the present invention, an additional possibility is afforded in that a spring is provided between the control switch and the long-hair trimmer, maintaining the long-hair trimmer in a position of use yielding to the pressure of the spring.

In a still further feature of the present invention, the long-hair trimmer is advantageously disposed on a slide means provided in the housing and adjustable by means of the control switch.

Finally, in a preferred embodiment of the solution of the present invention, a plate receiving the long-hair trimmer is adjustably mounted on the slide means in one or several guiding members, the slide means being adjustable to various positions by means of the control switch. By means of the plate receiving the long-hair trimmer, the long-hair trimmer is readily displaceable to the desired position of use in which it then follows the facial contour readily by virtue of its spring mounting.

It is of particular importance to the present invention that one or several springs are arranged on guide pins, bearing with one end against the plate and with another end against an abutment provided on the slide means. This ensures a perfect functioning of the long-hair trimmer without involving the risk of skewing.

In connection with the arrangement of the long-hair trimmer and the plate, the plate advantageously includes a hook member securing the plate in an end position.

It is further advantageous that the plate includes two relatively spaced hook members provided with sliding surfaces suitable for abutting engagement with sliding surfaces provided on the slide means as the plate is inserted into the slide means, whereby the hook members are bent apart such as to enable the plate to be adjusted to a holding position. In this manner, the long-hair trimmer is located in position on the slide means in one direction.

In addition, a space is advantageously provided between the two abutments on the plate and on the slide means and an edge, the space providing the range within which the long-hair trimmer is allowed to move up and down when in the floating position.

In another feature of the present invention, the plate receiving the long-hair trimmer is advantageously lockable in its up and down movement in at least one position by a detent means which holds the resilient bearing immovable and is adapted to bring its upper edge into abutment with a lower edge of the plate, as for the "trimming" position, for example.

Further, the detent means is advantageously secured to the lower portion of the slide means.

In a still further feature of the device of the present invention, an additional possibility is afforded in that the long-hair trimmer is displaceable into a "trimming" position by the control switch, in which process the detent means travels along a slope provided in a slot in a housing wall, causing the detent means to be moved into a locking position in which the detent means abuts the lower edge of the plate, thereby preventing a downward movement of the long-hair trimmer, with the long-hair trimmer being unlocked automatically when the "trimming" position is left.

In a still further embodiment of the present invention, the long-hair trimmer is advantageously pivotally mounted on an axle received in respective end members of the slide means and the housing. As a result, the angle of engagement of the long-hair trimmer adapts infinitely variably.

Still further, the position of the pivotal long-hair trimmer is advantageously variable in dependence on the actuating travel of the control switch by means of a control device comprising a control rod having its one end operatively associated with an actuating member of the long-hair trimmer and its other end with a coulisse guideway.

It is further particularly advantageous that the coulisse guideway comprises, among other elements, a control disk pivotally connected by means of a pin to the lower end of the control rod which is operatively associated with a cylinder of the long-hair trimmer by a hinge pin secured to the control rod upper end, so that on a displacement of the slide means and thus of the control rod in upward direction, the cylinder is turned downwards by an angle in the range of between 0° and 120° relative to the longitudinal mid-plane of the shaving apparatus. It is also advantageous that the coulisse guideway is comprised of a control disk and three slot-shaped cam segments, whereof two slot-shaped cam segments are of a straight-line configuration disposed in horizontally offset relation to each other, and are interconnected by the third, slot-shaped cam segment extending in a sloping fashion. It is another advantage that the sloping cam segment of the coulisse guideway is curved in such a fashion that the long-hair trimmer, in moving up and down, is continually turned into the one or the other direction within an angular range. In consequence, the angle of engagement of the long-hair trimmer conforms optimally to the skin surface.

To this end, it is advantageous that the control disk is on one side connected with the control rod through a pin, being on its other side slidably received in a slot-shaped cam segment provided on the housing or in an end member of the housing through a guide pin, and that the control disk is further rotatably supported on a pin in an end member of the slide means. As a result, a displacement of the control switch and the associated slide means produces automatically and in a simple manner a displacement of the long-hair trimmer into the proper position of use or, alternatively, the "Off" position or transit position.

In a particular embodiment it is finally provided to couple the control switch to a switch plate which is adapted to be locked in at least one position by a detent device which is configured as a detent plate pivotally connected to the switch plate by a pin and guided, through a second pin, in a slot-shaped curved coulisse provided in the housing, such that a displacement of the switch plate produces a rotary motion of the detent plate within the coulisse, holding the long-hair trimmer immovable in the "Off" position of the slide switch and releasing the long-hair trimmer in another position.

In a further feature of the device of the present invention constituting another embodiment, the long-hair trimmer is arranged on a slide means adjustably mounted in the housing and bearing resiliently against the housing by means of a spring configured as a bow-type spring which in one position urges the long-hair trimmer upward, urging it downward after overcoming dead center, the spring having its one end secured to a pin on the housing while its other end takes support in a recess provided in the slide means in which it rolls along, the slide means being adapted to be held immovable in a bottom position by a resilient locking means.

In still another embodiment, a long-hair trimmer head receiving the long-hair trimmer is resiliently mounted on the slide means, the long-hair trimmer head being coupled to the slide means by means of resilient locking hooks.

An embodiment of the present invention will now be described by way of example with reference to the accompanying drawings. In the drawings, FIG. 1 is a front view of a shaving apparatus incorporating a shaving head, a long-hair trimmer assembly, a control switch, and an On/Off switch;

Figure 1:
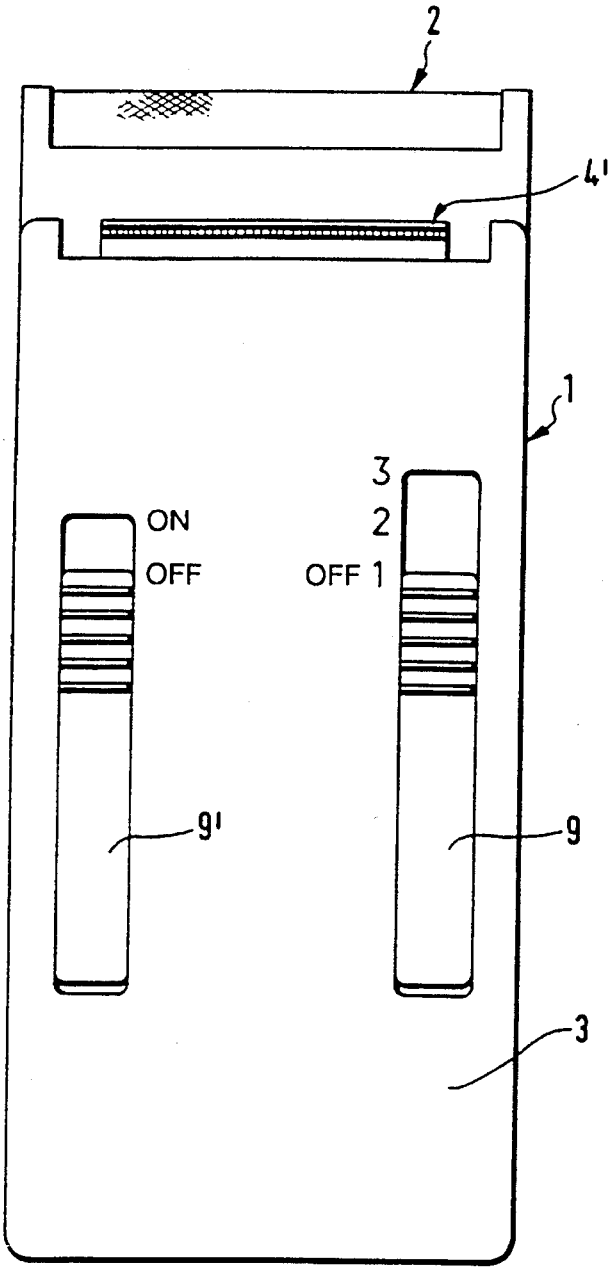
Figure 2:
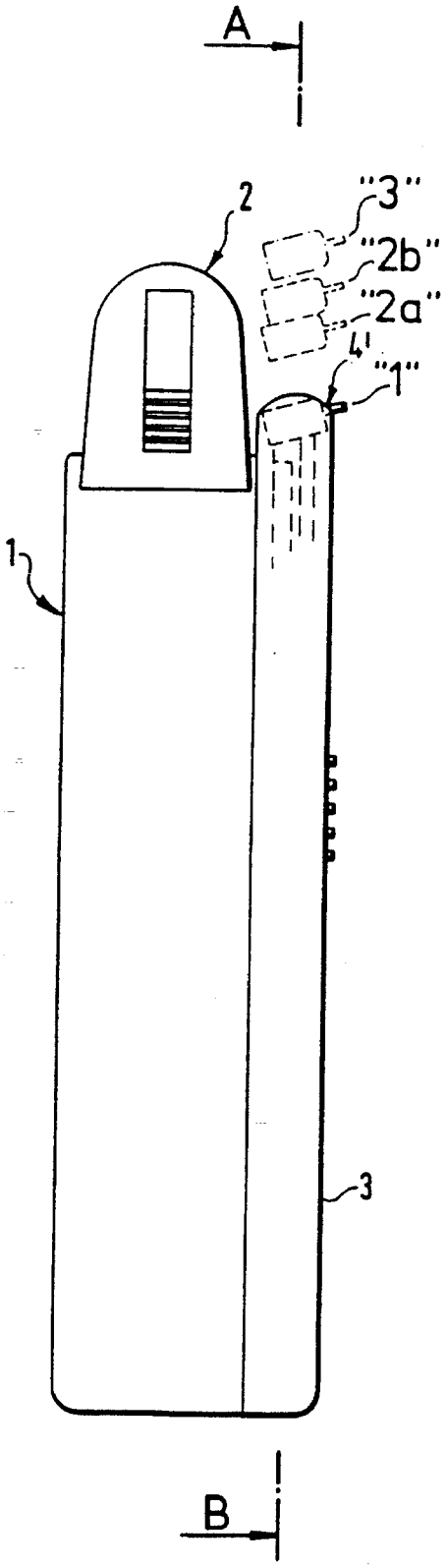
FIG. 2 is a side view of the shaving apparatus of FIG. 1.

Referring now to FIG. 1 of the drawings, there is shown an electric shaving apparatus having a housing 1 and a short-hair cutter assembly 2 as well as a fist control switch 9 slidably arranged on the front panel 3 of the housing 1 and associated with a long-hair trimmer assembly 4.

The long-hair trimmer assembly 4 is comprised of a slide means 15 and a long-hair trimmer 4' slidably mounted therein. The slide means 15 is slidably received on the front panel of the housing 1 behind the housing wall 8.

The long-hair trimmer assembly 4 includes a plate 40 of a T-shaped configuration. The plate 40 of the long-hair trimmer assembly 4 is guided within two relatively spaced guiding members 22. To this end, the long-hair trimmer 4' has on its front side two relatively spaced guide elements 31 provided with a respective guide groove 32 slidably receiving therein a respective guiding member 22. The two guiding members 22 are fixedly mounted on the plate 40 of the long-hair trimmer assembly 4.

In addition, the elongate plate 40 extending in downward direction is vertically movably received in a slotted opening 24 as well as in a rectangular opening 30. The slotted opening 24 and the opening 30 are provided in the slide means 15 slidably mounted on the front panel of the housing 1.

Seated between an upper edge 33 of the plate 40 and a lower edge 34 is a respective spring 36 mounted on a respective guide pin 35. The upper end of each guide pin 35 is fixedly connected with the respective right-hand and left-hand guide element 31, while the lower end thereof is slidably received in a respective bore 29 provided in the slide means 15. In the "combination" position (see also FIG. 7), when a downward pressure is exerted upon the long-hair trimmer 4' the long-hair trimmer 4' is able to move or recede downward, thereby conforming itself optimally to the contours of a person's skin because the angle of engagement of the long-hair trimmer 4' adapts continually to the outer contour.

The long-hair trimmer 4' is driven by the electric motor, not shown in the drawings, and by an oscillating bridge member shown at 39 in the drawings and including a slot 41. An oscillating lever 37 pivotally mounted on the plate 40 and having its one end coupled to the cutting blade of the long-hair trimmer 4' through an engaging means 38, while its other end is coupled to the driving member 39 through a pin 128 engaging within the slot 41, transmits the oscillating movement of the oscillating bridge member to the cutting blade.

The control switch 9 by means of which the long-hair trimmer assembly 4 is adjustable to any one of the three settings "1" to "3" is slidably disposed on the housing wall 8 of the shaving apparatus.

Setting "1" corresponds to an "Off" position, and setting "2" to a "combination" position in which the long-hair trimmer 4' is spring-mounted and capable of receding downward on application of pressure on the long-hair trimmer 4'.

Setting "3" corresponds to a "trimming" position in which the long-hair trimmer assembly 4 is locked in position, as will be further explained in the following.

A further control switch 9' merely serves the function of moving the short-hair cutter assembly 2 of the shaving apparatus from an "Off" position (Off) into an operating position (On).

Figure 3:
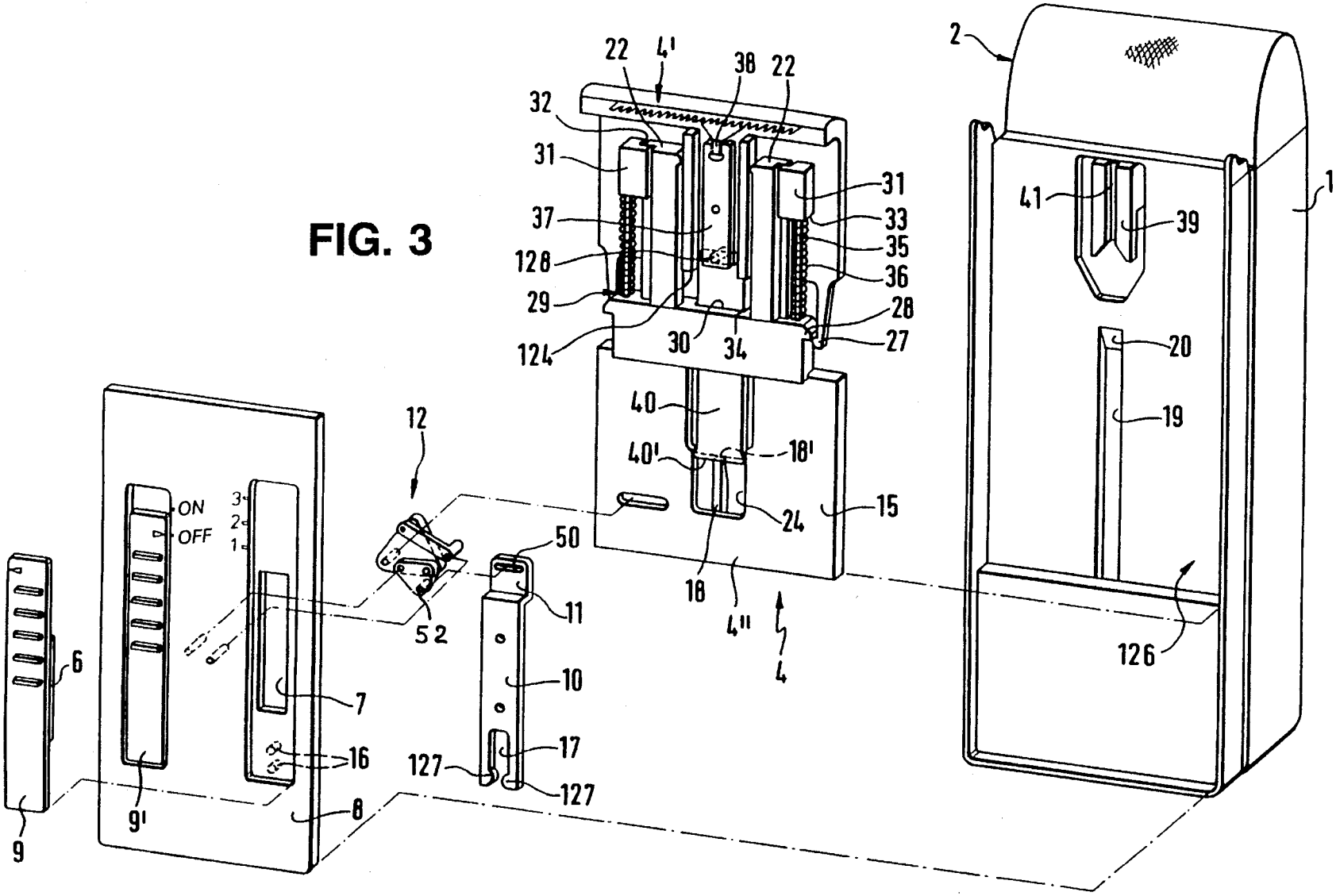
FIG. 3 is an exploded view of the shaving apparatus incorporating a long-hair trimmer.

As becomes further apparent from FIG. 3, the control switch 9 has on its rear side a guide element 6 adjustable within a slotted opening 7 provided in the housing wall 8 to any one of the settings "1, 2, 3".

By means of the guide element 6 and connecting pins, the control switch 9 is connected with a switch plate 10 having at its upper end an angled actuating member 11 with a coulisse 50 for receiving an engaging pin 52. The engaging pin 52 is part of a coupler mechanism 12.

As becomes further apparent from FIG. 3, the long-hair trimmer 4' is urged upwardly by means of the two springs 36. The upward movement of the long-hair trimmer 4' is limited by two hook members 27 arranged on the side of the plate 40 for engagement with suitable projections 28 provided on the slide means 15.

The hook members 27 provided on the plate 40 include sliding surfaces suitable for abutting engagement with sliding surfaces provided on the slide means 15 as the plate 40 is inserted into the slide means 15, whereby the hook members 27 are bent apart such as to adjust the plate 40 to a holding position.

The downward movement of the long-hair trimmer 4' is limited by engagement of the abutment 124 of the plate 40 against the edge 34 provided on the slide means 15. Between the abutment 124 of the plate 40 and the edge 34, a distance of up to 10 mm is provided, which is the range in which the long-hair trimmer 4' is allowed to move up and down when in the floating position.

At the settings "1", "2" and "3" the control switch 9 is adapted to be locked in place by means of locking pins 16 engaged by a bifurcated portion 17 of the switch plate 10 on which knobs 127 are provided.

Figure 4:
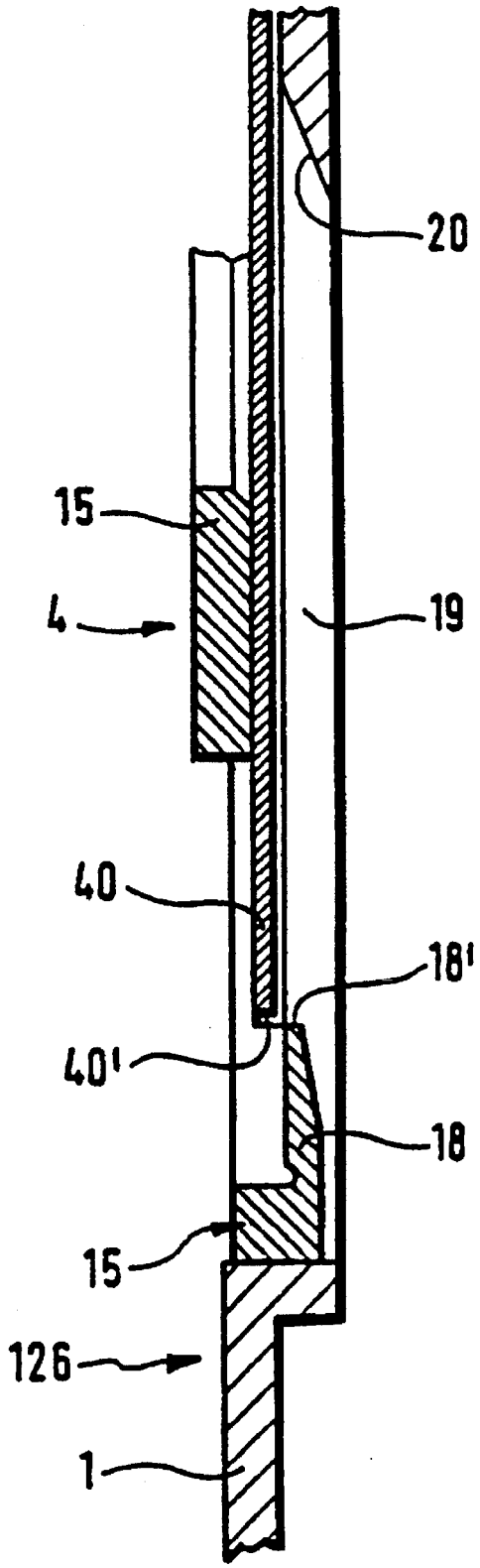
FIG. 4 is a sectional view taken along the line A–B of FIG. 2.

At the setting "3" which corresponds to the "trimming" position, a detent means 18 locks the movement of the long-hair trimmer 4' or the plate 40 relative to the lower portion 4" of the slide means 15. To this effect, the detent means 18 rests with its upper edge 18' against a lower edge 40' of the plate 40. The detent means 18 is secured to the lower portion 4" of the slide means 15 and is of a resilient configuration (see FIG. 4). When the control switch 9 moves the long-hair trimmer assembly 4 into the "trimming" position, the detent means 18 will travel along a slope 20 provided in the slot 19, causing the detent means 18 to move into the locked position of FIG. 3 in which it rests against the lower edge 40' of the plate 40, thereby preventing a downward movement of the long-hair trimmer 4'. The slot 19 is provided in a housing wall 126 of the housing 1. Unlocking of the detent means 18 occurs in the reverse sequence.

FIGS. 5 to 9 show a further embodiment of a shaving apparatus with a long-hair trimmer 4' which is adjustable by means of the control switch 9.

Figure 9:
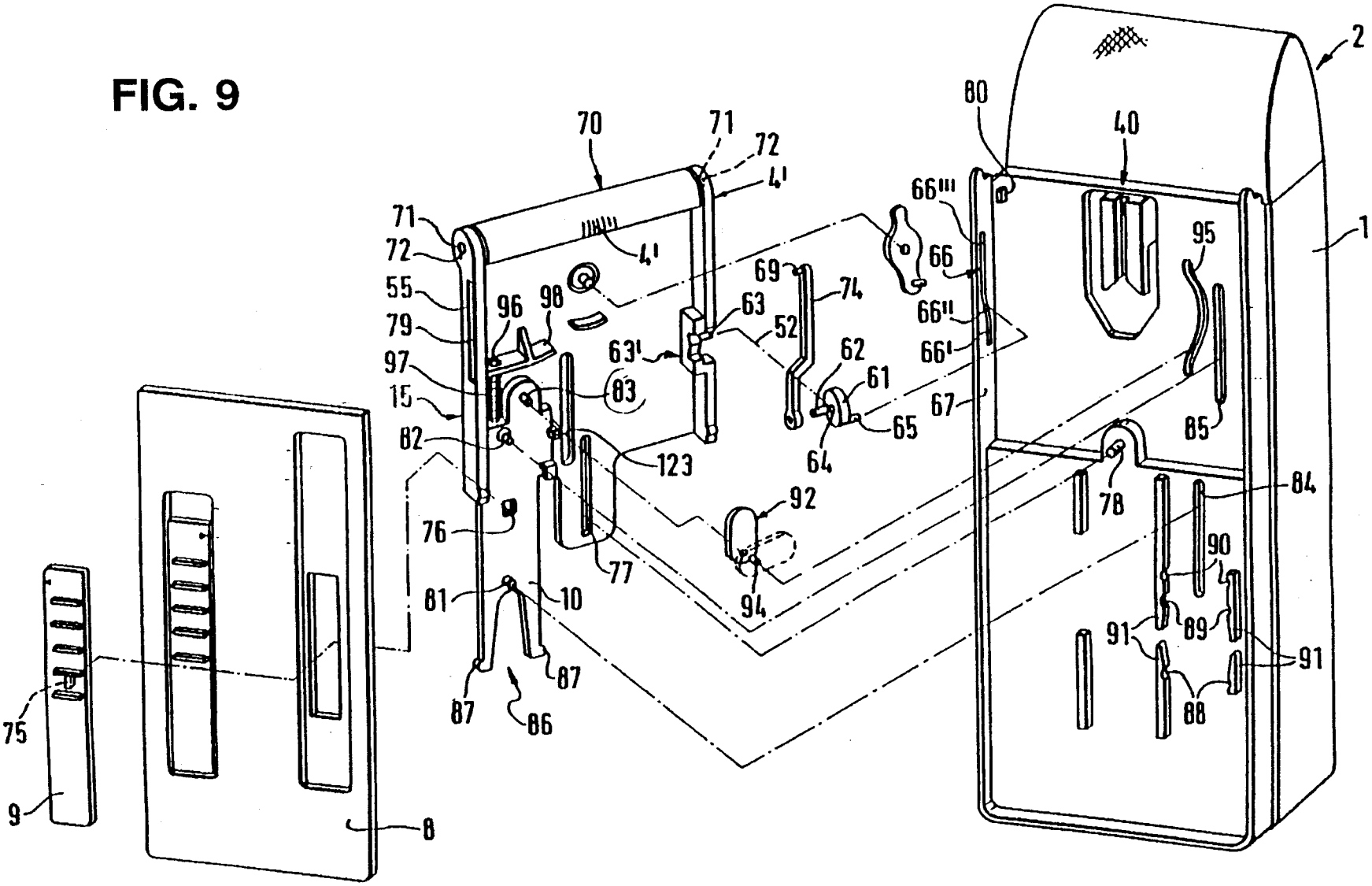
FIG. 9 is an exploded view of the long-hair trimmer of FIG. 5.

As becomes apparent from the exploded view of FIG. 9, the control switch 9 is slidably disposed on the housing wall 8 and operatively associated with an opening 76 provided in the switch plate 10 by an engaging means 75, thus enabling the control switch 9 to move the switch plate 10 into any one of the settings "1" to "3".

As becomes further apparent from FIG. 9, the slide means 15 is guided both by a slot 77 provided in the slide means 15 and engaged by a pin 78 disposed on the housing 1, and by at least one further slot 79 provided in an end member 55 of the slide means 15 for engagement with a guide element 80 provided in an end member 67 of the housing 1.

The switch plate 10 is guided on two protruding pins 81, 82. The pins 81 and 82 are vertically movably guided in respective slots 84 and 85. In this embodiment, the switch plate 10 performs two functions. First, it is used as a basic slide structure and furthermore serves at the same time as a switch plate. In this embodiment, the long-hair trimmer 4' is spring-mounted relative to the switch plate 10. In FIG. 9, the long-hair trimmer 4' is not vertically adjustable relative to the slide means 15.

By means of a locking device 86, the slide means 15 movably mounted in the housing 1 is lockable at any one of the settings "1" to "3" according to the first embodiment. The locking device 86 is comprised of two bifurcated locking hooks 87 adapted for locking engagement within two opposed lower recesses 88, two middle recesses 89 provided above the lower recesses, and two upper recesses 90. The lower recesses 88 serve to locate the control switch 9 in the "Off" position, the middle recesses 89 to locate the control switch 9 in the "combination" position, and the upper recesses 90 to locate the control switch 9 in the "trimming" position. The individual recesses 88 to 90 are arranged on respective ledges 91.

The control switch 9 serves to adjust and lock the long-hair trimmer 4' in position. To this end, the control switch 9 is connected with a detent device configured as a detent plate 92. The detent plate 92 is pivotally connected to the switch plate 10 by means of a pin 83 and guided in a slotted and curved coulisse 95 provided in the housing 1 by means of a second pin 94, such that a displacement of the switch plate 10 causes the detent plate 92 to perform a rotary motion within the coulisse 95. In the "Off" position, the detent plate is in the vertical position shown in FIG. 9 in which the long-hair trimmer 4' is locked in place.

When the switch plate is moved to setting "2", that is, the "combination" position, the detent plate 92 will assume the horizontal position shown in FIG. 9 in broken lines.

When the control switch 9 is moved farther up into the "trimming" position, the detent plate 92 which is then rotated, extending thus in a vertical direction, will abut against a rib member 98 disposed in the slide means 15 and extending horizontally relative to the slide means 15, thereby inhibiting a further downward movement of the long-hair trimmer 4'.

In the "combination" position, the long-hair trimmer 4' is in a position to recede to conform optimally to the facial contour, irrespective of how the shaving apparatus is moved over the skin surface. The floating arrangement of the long-hair trimmer 4' ensures a consistently favorable cutting angle as well as permanent engagement with, and continual adaptation to, the skin surface.

In the "combination" position, the detent means 92 allows a travel of a length of between 3 to 6 mm, approximately.

When the detent plate 92 is moved from the "Off" position to the "combination" position, the action of a spring 97 mounted on a pin 96 for adjustment of the long-hair trimmer 4' is supported by the detent plate 92, eliminating the need for the spring 97 to provide the full force for displacement of the long-hair trimmer 4' alone.

Figure 5:
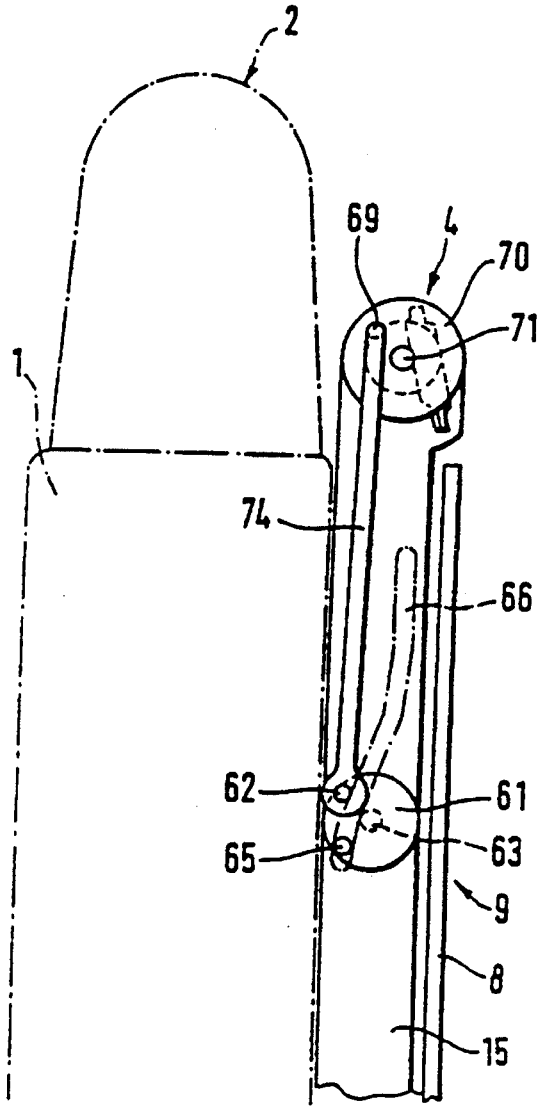
FIG. 5 is a further embodiment of an adjustable long-hair trimmer which is in addition pivotally and movably carried, the position shown indicating the "Off" position of the long-hair trimmer.

The shaving apparatus illustrated in FIG. 5 is in its lowermost position corresponding to the "Off" position or a "transit" position in which the long-hair trimmer 4' is tilted fully downwards.

Turning of the long-hair trimmer 4' is accomplished in this embodiment by providing the shaving apparatus with a control system as illustrated in FIGS. 5 and 9.

As becomes apparent from FIGS. 5 and 9, the control system is comprised of a control disk 61 rotatably mounted in a bearing 63' in the long-hair trimmer assembly 4 by means of a pin 63. The pin 63 is further received in a bore 64 in the control disk 61. Moreover, the control disk 61 has secured to it a guide pin 65 slidably received in a coulisse guideway 66 provided on the end member 67 of the housing 1.

On upward displacement of the slide means 15, a rotary motion will be transmitted through the coulisse guideway 66 to the control disk 61. The control disk 61 is further pivotally connected by a pin 62 to the lower end of a control rod 74 which in turn is operatively associated with a cylinder 70 of the long-hair trimmer 4' by means of a hinge pin 69 secured to its upper end, so that a displacement of the slide means 15 and thus of the control rod 74 in upward direction causes the cylinder 70 to be turned downward in clockwise direction when viewing the drawing by an angle of up to 120° (see FIGS. 5 and 9).

The cylinder 70 of the long-hair trimmer 4' has at either end thereof a trunnion 71 rotatably received in respective bores 72 provided in respective end members 55 of the slide means 15.

The individual settings of the long-hair trimmer 4' are obtained by the curved extent of the coulisse guideway 66. The coulisse guideway 66 comprises three cam segments 66', 66", and 66'''. The two cam segments 66', 66''' are of a straight-line configuration and disposed in horizontally offset relation to each other in such a fashion that the long-hair trimmer 4' can be turned through the control rod 74 by an angle of up to 90°. The two cam segments 66', 66''' are connected to each other through a sloping cam segment 66". The relative distance of the two cam segments 66' and 66''' influences the range of adjustment of the long-hair trimmer 4'. The upper cam segment 66''' may continue in a further cam segment in order to have an additional setting option in the uppermost position which corresponds to the "trimming" position of the long-hair trimmer 4', thereby enabling the angle of engagement of the long-hair trimmer 4' with the skin surface to be increased or decreased.

FIGS. 5 to 8 illustrate the individual positions of the cylinder 70 and the associated long-hair trimmer 4'.

FIG. 5 shows the slide means 15 in its lowermost position in which the long-hair trimmer 4' is turned fully down. This position corresponds to the "Off" position (setting "1").

Figure 6:
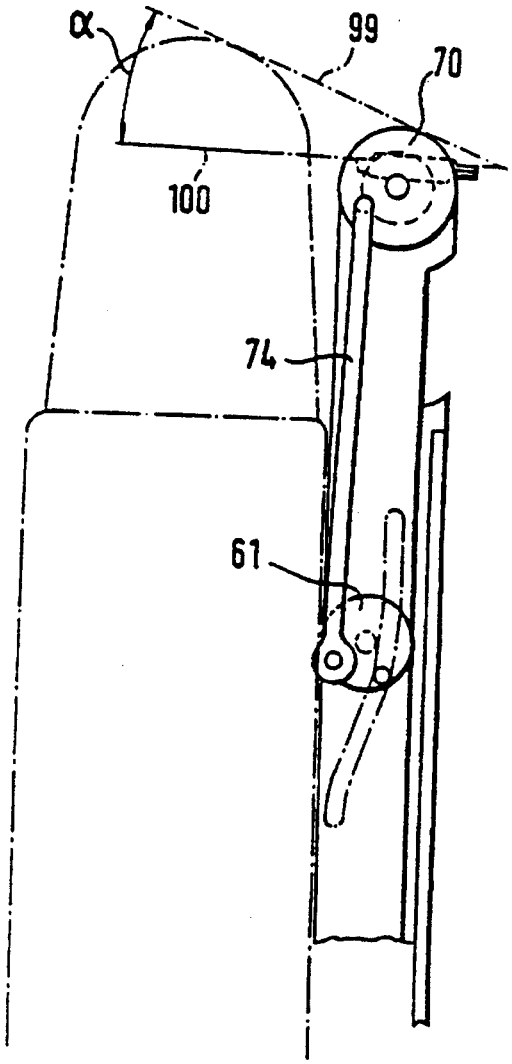
FIG. 6 is a view of the long-hair trimmer of FIG. 5 showing it at the lower setting of its "combination" position.
Figure 7:
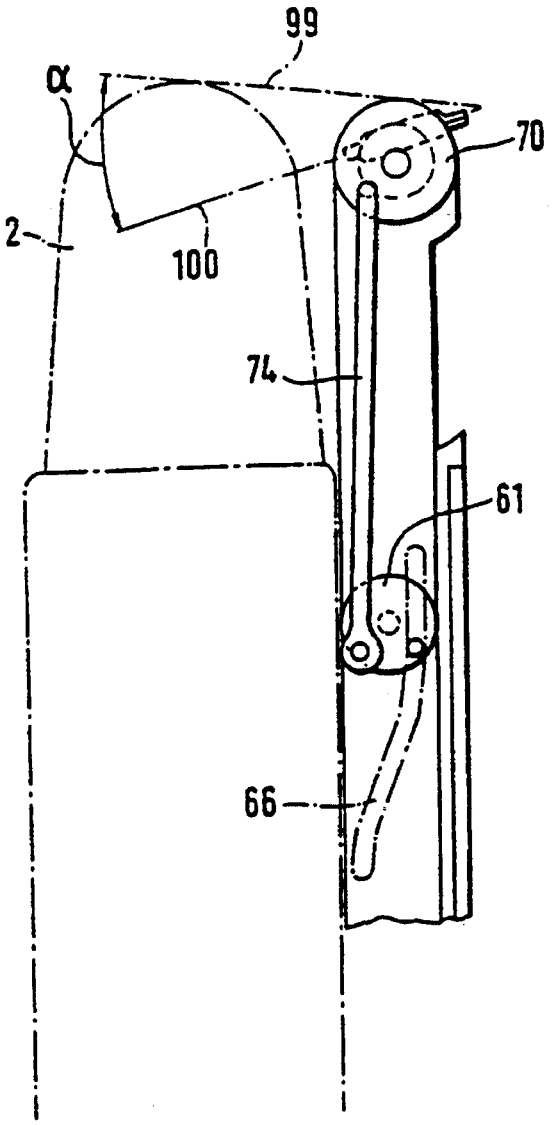
FIG. 7 is a view of the long-hair trimmer of FIG. 5, showing it at the upper setting of its "combination" position.

In FIGS. 6 and 7, the long-hair trimmer 4' is in a "combination" or floating position, FIG. 6 reflecting the lower and FIG. 7 the upper setting of the long-hair trimmer 4' when in the "combination" position. In the "combination" position, the detent plate 92 extends horizontally, allowing an up-and-down movement of the long-hair trimmer 4' against the action of the spring 97 which bears against the pin 96 between the rib member 98 and the upper part of the control switch 9.

The control switch 9 (see FIG. 9) is guided in a slotted opening 7 in the housing wall 8 and snapped onto the switch plate 10 which is slidably received in a guideway 123 provided on the slide means 15.

When a force is exerted on the long-hair trimmer 4' when in the "floating" position according to FIGS. 6 and 7, it will be urged up and down between the two positions illustrated in FIGS. 6 and 7. As this occurs, the position of the long-hair trimmer 4' will vary slightly on account of the control rod 74, with the angle $\alpha$ formed between the tangent 99 and the center line 100 of the long-hair trimmer 4' being maintained approximately constant.

Figure 8:
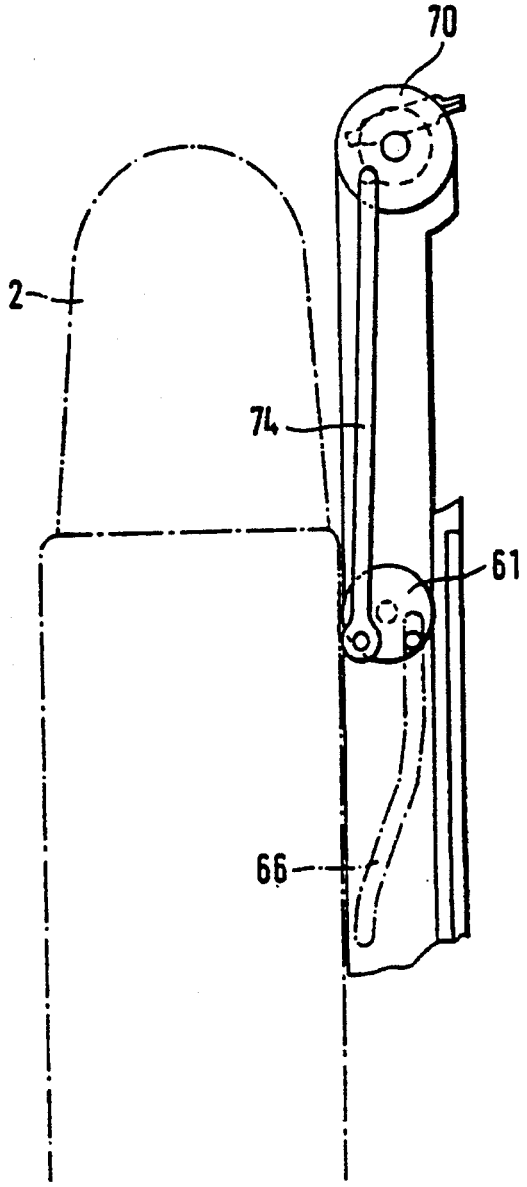
FIG. 8 is a view of the long-hair trimmer of FIG. 5 in its "trimming" position.

In FIG. 8, the long-hair trimmer 4' is shown in its "trimming" position in which its downward movement is locked by the detent plate 92.

Figure 10:
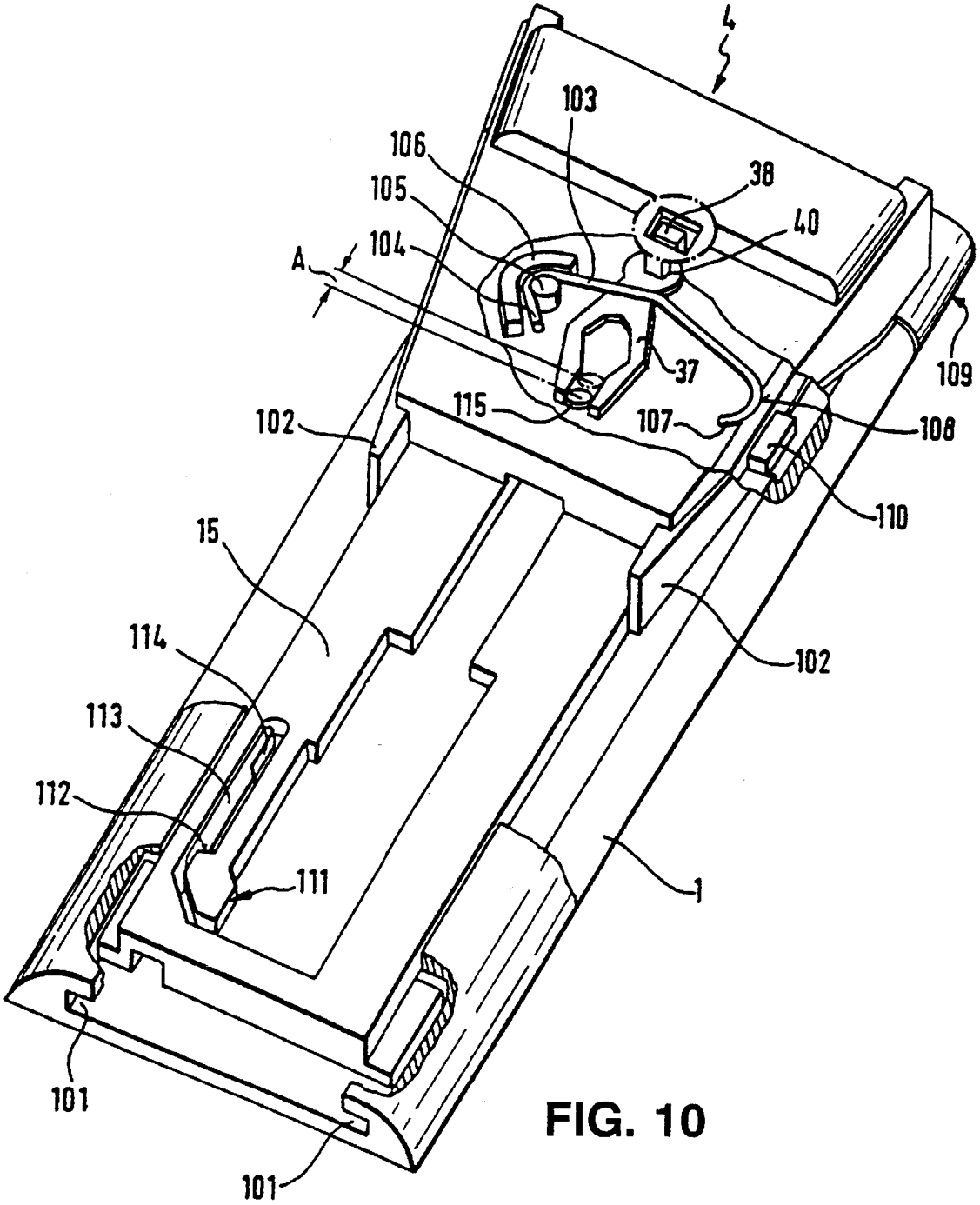
FIG. 10 is a further embodiment of a movably carried long-hair trimmer, the position shown indicating the "Off" position of the long-hair trimmer.
Figure 11:
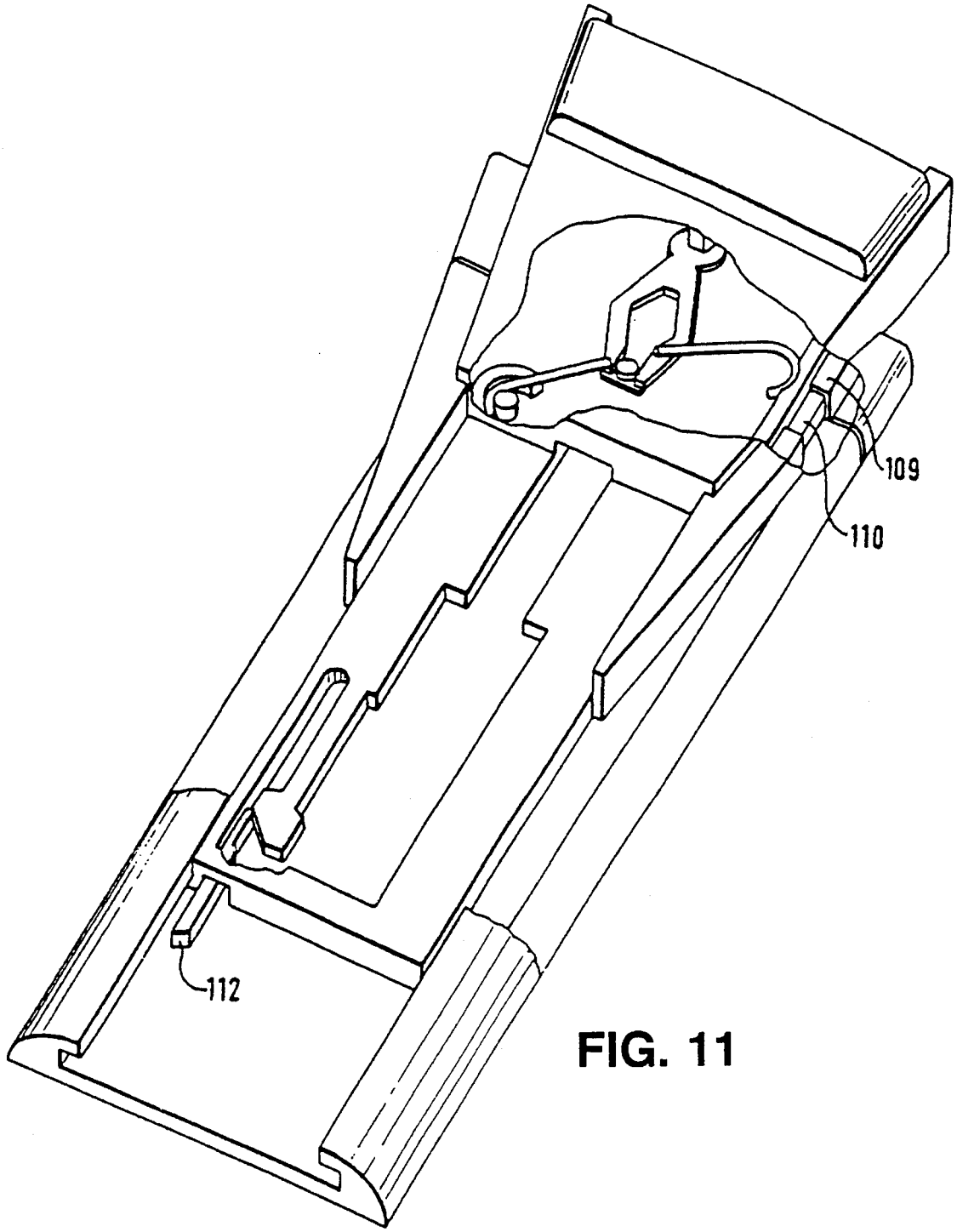
FIG. 11 is a view of the movably carried long-hair trimmer of FIG. 10 showing it in its operating position.

FIGS. 10 and 11 illustrate a further embodiment of a long-hair trimmer assembly 4, wherein like parts of the shaving apparatus are assigned like reference numerals.

The slide means 15 of a shaving apparatus shown only partially in the drawing is vertically movably guided on the housing 1 in a dovetail guideway 101. An additional guideway for the slide means 15 is provided laterally in the upper area by outer end walls 102.

In the upper area (see FIG. 11), the slide means 15 bears against a spring 103 configured as a bow-type spring. According to FIG. 10, the spring 103 has at its left-hand end a hook member 104 disposed on a protruding pin 105 by clamping engagement between the pin 105 and a mount 106 conformed to the shape of the hook member 104. The end of the spring opposite the hook member 104 is equally provided with an outwardly curved hook member 107 which takes support in the slide means 15 upon a recess 108 conformed to the shape of the hook member 107 and causes the slide means 15 to be urged with an abutment 110 thereof upwardly against a stop 109 until the shaving head 2 or the long-hair trimmer assembly 4 is urged downwardly by a counterforce.

In the position shown in FIG. 10, the spring 103 has passed dead center in downward direction, exerting in this position a downward actuating force and causing the slide means 15 to assume its "Off" position. When the slide means is shifted to the position illustrated in FIG. 11, the spring 103 will pass dead center in upward direction, being then biased such as to move the slide means 15 upwardly to an operating position.

As becomes apparent from FIG. 10, the slide means 15 includes in its lower left-hand area a locking means 111 which is of a resilient configuration and bears with its lower end against a slope 112 configured as an abutment. In this position, the apparatus is in an "Off" position or at setting "1" in which the long-hair trimmer 4' is equally locked in place.

When the control switch 9 is moved from setting "1" to setting "2" as shown in FIG. 11, the locking means 111 will be guided over a rib member 113 adjacent to the slope 112 and bent outwardly in the process, until the locking means 111, upon reaching a recess 114 adjacent to the rib member 113, springs back, thereby releasing the slide means 15 for an up-and-down movement. This setting "2" corresponds to the "floating" position of the long-hair trimmer 4'. In this position, the long-hair trimmer 4' is allowed to move up and down within a range of between 3 and 4 mm when the shaving head engages the skin surface, thereby exerting a downward force on the long-hair trimmer 4'. During the shaving operation, the spring 103 ensures that the long-hair trimmer 4' is at all times urged upwardly for optimum engagement with the skin surface.

The long-hair trimmer 4' of FIG. 10 is equally driven by the electric motor, not shown in the drawings, which causes an oscillating movement of the long-hair trimmer 4' by means of the oscillating lever 37 and an engaging means 38 as well as a slot 41 provided in the oscillating bridge member 39. In this embodiment, the driving speed or the amplitude at which the long-hair trimmer 4' oscillates will slightly vary when the long-hair trimmer 4' is moved up and down at setting "2", whereas the amplitude is maintained constant in the two first-mentioned embodiments. In the embodiment of FIGS. 10 and 11, the oscillating lever 37 which is driven by the electric motor through a drive pin 115 is moved up and down within a distance A in dependence upon the motion of the slide means 15. Accordingly, the position of the drive pin 115 relative to the oscillating lever 37 remains unchanged.

Figure 12:
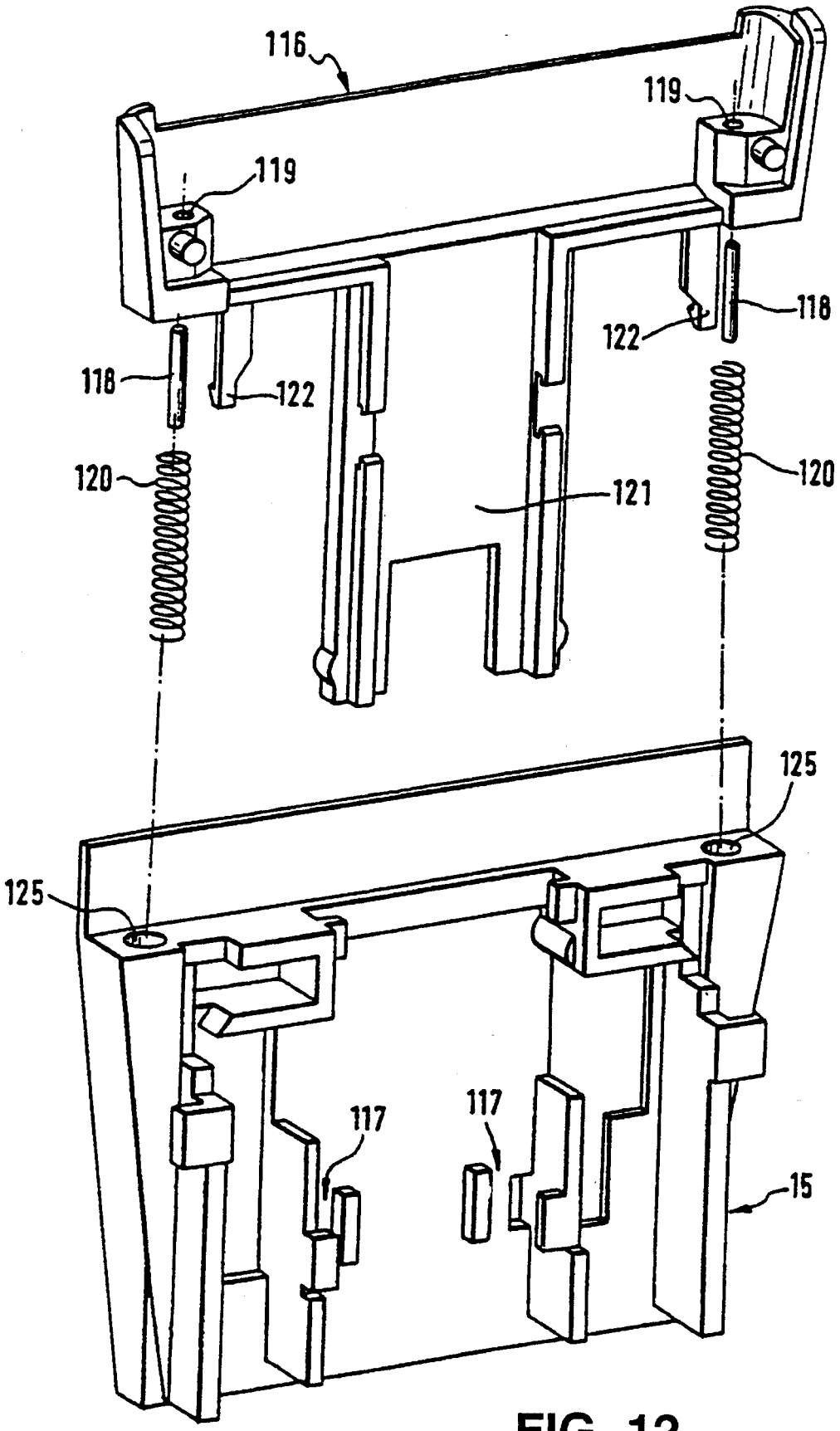
FIG. 12 is a view of the movably carried long-hair trimmer in which the upper part of the long-hair trimmer is floatingly carried on the slide means.

FIG. 12 shows a fourth embodiment of an adjustable long-hair trimmer 4' with the upper part of the long-hair trimmer 4' being separate from the slide means 15 and also capable of receding relative thereto.

In FIG. 12, the long-hair trimmer 4' is disposed in a long-hair trimmer head 116 which is slidably received in guide elements 117 of the slide means 15 by means of a guide plate 121. For this purpose, the long-hair trimmer head 116 and the slide means 15 have at either end thereof respective bores 119 and 125 for receiving respective guide pins 118. Mounted on the guide pins 118 are respective springs 120 invariably urging the long-hair trimmer head 116 upwards when the control switch 9 not shown in this Figure is in its "combination" or floating position (setting "2"). To prevent the guide plate 121 from becoming disengaged from the guide elements 117, locking hooks 122 are provided at either end of the long-hair trimmer head 116 for engagement with locking means provided on the slide means 15. The remaining components being in principle identical to the components of the third or second embodiment, these will not be discussed again. This embodiment differs from the preceding embodiments only in that the long-hair trimmer head 116 is of a separate configuration while yet being displaceable upwards, in conjunction with the slide means 15 and the long-hair trimmer 4', by means of a central switch not shown in the drawings, and that also on upward displacement of these parts the long-hair trimmer 4' remains in a floating position in which it is capable of receding downwards during shaving when a corresponding pressure is exerted on the long-hair trimmer 4'.

As in the other embodiments, the long-hair trimmer 4' is locked in place when in the "trimming" position.

We claim:

1. An electric shaving apparatus having housing structure, long-hair trimmer structure arranged on said housing structure, said long-hair trimmer structure including a cutting blade and a structure in which said cutting blade is mounted, at least one short-hair cutter assembly arranged on said housing structure, at least one control switch on said housing structure and operable to vertically adjust said long-hair trimmer structure in the direction of said short-hair cutter assembly from an "Off" position to at least one operating position, and spring structure on said housing structure and coupled between said control switch and said long-hair trimmer structure, said spring structure maintaining said long-hair trimmer structure, including said cutting blade and said structure in which said cutting blade is mounted, in a floating position of use yielding to the pressure of said spring structure in at least one operating position of said control switch.

2. The shaving apparatus of claim 1 and further including detent structure in said housing structure and responsive to said control switch in a second operating position for latching said long-hair trimmer structure in fixed position relative to said short-hair cutter assembly.

3. The shaving apparatus of claim 1 and further including slide structure in said housing structure, wherein a position of said slide structure is adjustable by said control switch and wherein said long-hair trimmer structure is disposed on said slide structure.

4. The shaving apparatus of claim 1 wherein said long-hair trimmer structure is pivotally mounted in said housing structure.

5. The shaving apparatus of claim 4 and further including control structure responsive to said control switch for varying the pivotal position of said long-hair trimmer structure in dependence on the actuating travel of said control switch.

6. The shaving apparatus of claim 5 wherein said housing structure includes a coulisse guideway and said control structure includes a control rod having one end connected to said long-hair trimmer structure and its other end connected to said coulisse guideway.

7. The shaving apparatus of claim 6 and further including slide structure in said housing structure and adjustable by said control switch and wherein said control structure includes a control disk pivotally connected to said control rod, said control rod being operatively associated with said long-hair trimmer structure by hinge pin structure secured to said control rod, so that on displacement of said slide means and thus of said control rod in upward direction, said long-hair trimmer structure is turned over an angle in the range of between 0° and 120°.

8. The shaving apparatus of claim 6 wherein said coulisse guideway is comprised of at least three slot-shaped cam segments, two of said slot-shaped cam segments being of straight-line configuration and disposed in horizontally offset relation to each other, and interconnected by a third slot-shaped cam segment that extends in sloping fashion relative to said two slot-shaped cam segments.

9. The shaving apparatus of claim 8 wherein said third cam segment extends at an inclination relative to the longitudinal mid-plane of the shaving apparatus such that said long-hair trimmer structure is adapted to pivot in an angular range of between 0° and 120°.

10. The shaving apparatus of claim 9 wherein said third cam segment is curved in such a fashion that said long-hair trimmer structure, in moving up and down, is continually turned within said angular range.

11. The shaving apparatus of claim 7 and further including a slot-shaped cam segment on said housing structure, and wherein said control disk includes pin structure on one side that is connected with said control rod and a guide pin on its other side that is slidably received in said cam segment.

12. The shaving apparatus of claim 7 wherein said control disk is rotatably supported on said slide structure.

13. The shaving apparatus of claim 1 and further including a detent device coupled to said control switch for locking said control switch in at least one position.

14. The shaving apparatus of claim 13 and further including a switch plate coupled to said control switch and a coulisse in said housing structure, and wherein said detent device is configured as a detent plate pivotally connected to said switch plate and guided in said coulisse such that displacement of said switch plate produces rotary motion of said detent plate holding said long-hair trimmer structure immovable in the "Off" position of said switch plate and releasing said

15. The shaving apparatus of claim 1 and further including slide structure in said housing structure that is adjustable by said control switch, and a bow type spring coupled to said slide structure, and wherein said long-hair trimmer structure is arranged on said slide structure and is urged resiliently against said housing structure by said bow-type spring which in one position urges said long-hair trimmer structure upward, and in a second position urges said long-hair trimmer structure downward after overcoming dead center.

16. The shaving apparatus of claim 15 wherein said bow-type spring has one end secured to said housing structure and another end supported in a recess in said slide structure, and further including resilient locking structure in said housing structure for holding said slide structure immovable in a bottom position.

17. The shaving apparatus of claim 1 and further including slide structure in said housing structure and adjustable by said control switch, and a long-hair trimmer head, said long-hair trimmer head being adapted to receive said long-hair trimmer structure and being resiliently mounted on said slide structure.

18. The shaving apparatus of claim 17 and further including resilient locking hook structure coupling said long-hair trimmer head to said slide structure.

19. An electric shaving apparatus having housing structure, guide structure in said housing structure, long-hair trimmer structure arranged on said housing structure, said long-hair trimmer structure including a cutting blade and a structure in which said cutting blade is mounted, at least one short-hair cutter assembly arranged on said housing structure, at least one control switch on said housing structure for vertically adjusting said long-hair trimmer structure in the direction of said short-hair cutter assembly from an "Off" position to at least one operating position, spring structure on said housing structure and coupled between said control switch and said long-hair air trimmer structure, said spring structure maintaining said long-hair trimmer structure, including said cutting blade and said structure in which said cutting blade is mounted, in a floating position of use yielding to the pressure of said spring structure in at least one operating position, slide structure in said housing structure and adjustable to various positions by said control switch, said long-hair trimmer structure being disposed on said slide structure, and plate structure receiving said long-hair trimmer structure and adjustably mounted on said slide structure in said guide structure.

20. The shaving apparatus of claim 19 wherein said slide structure includes abutment structure, and further including guide pin structure, said guide pin structure having one end bearing against said plate structure and another end bearing against said abutment structure on said slide structure.

21. The shaving apparatus of claim 19 wherein said plate structure includes at least one hook member securing said plate structure in end position relative to said slide structure.

22. The shaving apparatus of claim 19 wherein said plate structure includes two relatively spaced hook members provided with sliding surfaces suitable for abutting engagement with sliding surfaces on said slide structure as said plate structure is inserted into said slide structure, said hook members being adapted to be spread apart such that said plate structure may be adjusted to a holding position.

23. The shaving apparatus of claim 19 and further including abutment structure on said plate structure and wherein space is provided between said abutment structure and a surface on said slide structure, said space defining the range within which said long-hair trimmer structure is allowed to move up and down when in said floating position.

24. The shaving apparatus of claim 19 and further including detent structure and wherein said plate structure is lockable in at least one position by abutment of said detent structure with a lower edge of said plate structure.

25. The shaving apparatus of claim 24 wherein said detent structure is secured to a lower portion of said slide structure.

26. The shaving apparatus of claim 24 wherein said housing structure includes slot structure with a sloped surface, and said long-hair trimmer structure is displaceable into a "trimming" position by said control switch, in which displacement process said detent structure travels along said sloped surface, causing said detent structure to be moved into a locking position in which said detent structure abuts said lower edge of said plate structure relative to said short-hair cutter assembly, thereby preventing downward movement of said long-hair trimmer structure, with said long-hair trimmer structure being released as said control switch is moved from said "trimming" position.

27. The shaving apparatus of claim 19 and further including a detent device coupled to said control switch for locking said control switch in at least one position.

28. The shaving apparatus of claim 27 and further including a switch plate coupled to said control switch and a coulisse in said housing structure, and wherein said detent device is configured as a detent plate pivotally connected to said switch plate and guided in said coulisse such that displacement of said switch plate produces rotary motion of said detent plate holding said long-hair trimmer structure immovable in the "Off" position of said switch plate and releasing said long-hair trimmer structure in another position of said switch plate.

29. The shaving apparatus of claim 19 and further including detent structure in said housing structure and responsive to said control switch in a second operating position for latching said long-hair trimmer structure in fixed position relative to said short-hair cutter assembly.

* * * * *

UNITED STATES PATENT AND TRADEMARK OFFICE
CERTIFICATE OF CORRECTION

PATENT NO. : 5,507,095

DATED : April 16, 1996

INVENTOR(S) : Matthias Wetzel et al.

It is certified that error appears in the above-identified patent and that said Letters Patent is hereby corrected as shown below:

Col. 11, claim 14, line 4, after "said" insert --long-hair trimmer structure in another position of said switch plate.--

Col. 11, claim 16, line 15, replace "bow-type" with --bow type--.

Col. 11, claim 19, line 44, delete "air".

Signed and Sealed this

Ninth Day of July, 1996

Bruce Lehman

*Attest:*

BRUCE LEHMAN

*Attesting Officer*

*Commissioner of Patents and Trademarks*